US009573374B2

(12) United States Patent
Wakabayashi

(10) Patent No.: US 9,573,374 B2
(45) Date of Patent: Feb. 21, 2017

(54) LIQUID EJECTING APPARATUS

(71) Applicant: SEIKO EPSON CORPORATION, Tokyo (JP)

(72) Inventor: Toshihiko Wakabayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 82 days.

(21) Appl. No.: 14/185,128

(22) Filed: Feb. 20, 2014

(65) Prior Publication Data

US 2014/0247304 A1 Sep. 4, 2014

(30) Foreign Application Priority Data

Mar. 4, 2013 (JP) ..... 2013-041592

(51) Int. Cl.
*B41J 2/165* (2006.01)
*B41J 11/00* (2006.01)

(52) U.S. Cl.
CPC ..... *B41J 2/16517* (2013.01); *B41J 11/002* (2013.01)

(58) Field of Classification Search
CPC ..... B41J 2/16517
USPC ..... 347/32
See application file for complete search history.

(56) References Cited

U.S. PATENT DOCUMENTS

| | | | | |
|---|---|---|---|---|
| 6,042,216 | A * | 3/2000 | Garcia et al. | 347/29 |
| 2002/0175968 | A1* | 11/2002 | Unosawa | 347/22 |
| 2006/0012629 | A1 | 1/2006 | Yoshida | |
| 2010/0238234 | A1 | 9/2010 | Inoue | |
| 2013/0044153 | A1* | 2/2013 | Sasaki et al. | 347/16 |

FOREIGN PATENT DOCUMENTS

| | | |
|---|---|---|
| JP | 2001-260368 | 9/2001 |
| JP | 2005-212351 | 8/2005 |
| JP | 2006-051806 | 2/2006 |
| JP | 2006-142702 | 6/2006 |
| JP | 2010-241127 | 10/2010 |
| JP | 2011-161794 | 8/2011 |
| JP | 2012-051142 | 3/2012 |
| JP | 2013-039708 | 2/2013 |

* cited by examiner

*Primary Examiner* — Manish S Shah
*Assistant Examiner* — Jeffrey C Morgan
(74) *Attorney, Agent, or Firm* — Workman Nydegger

(57) ABSTRACT

A liquid ejecting apparatus includes a liquid ejecting head having a nozzle formed surface on which a nozzle which is capable of ejecting a liquid towards a target is formed, a support portion which can support the target, a carriage which can reciprocate in a scanning direction with the liquid ejecting head held, and a maintenance section which is detachably mounted on a maintenance area outside the support portion in the scanning direction to perform maintenance on the liquid ejecting head, and in which, when the maintenance section is attached or detached, the carriage has the nozzle formed surface moving to a position facing the support portion.

19 Claims, 3 Drawing Sheets

LIQUID EJECTING APPARATUS

BACKGROUND

1. Technical Field

The present invention relates to a liquid ejecting apparatus such as an ink jet printer.

2. Related Art

In the related art, an ink jet printer is known as a type of a liquid ejecting apparatus, which performs printing by ejecting an ink onto a sheet of paper and the like from a nozzle of a liquid ejecting head. Such printer includes a wiping member which absorbs and removes an unnecessary ink adhered to a nozzle formed surface of the liquid ejecting head in a maintenance section which performs maintenance of the liquid ejecting head (for example, JP-A-2001-260368).

Incidentally, when a wiping member in the printer described above finishes absorbing an ink by wiping the ink adhered to a nozzle formed surface, it is necessary that the wiping member is replaced with a new wiping member which has not absorbed any ink. Thus, during the replacement of wiping members, there is a risk that the carelessness of a printer user makes a wiping member contact an internal structure of a printer such as a liquid ejecting head and the like. Further, there is a problem that the internal structure of the printer such as the liquid ejecting head and the like cannot normally operate due to an impact at the time of the contact.

The aforementioned situation is common not only in an ink jet printer but also in a liquid ejecting apparatus performing maintenance on the liquid ejecting head by using an replaceable maintenance section.

SUMMARY

An advantage of some aspects of the invention is to provide a liquid ejecting apparatus which can prevent a maintenance section from contacting a configuration member of a device, such as a liquid ejecting head and the like, at the time of attaching or detaching the maintenance section for maintaining the liquid ejecting head.

Hereinafter, means of the invention and operation effects thereof will be described.

According to an aspect of the invention, there is provided a liquid ejecting apparatus, including a liquid ejecting head having a nozzle formed surface on which a nozzle which is capable of ejecting a liquid towards a target is formed, a support portion which can support the target to which the liquid is ejected, a carriage which can reciprocate in a scanning direction with the liquid ejecting head held, and a maintenance section which is detachably mounted on a maintenance area outside the support portion in the scanning direction to perform maintenance on the liquid ejecting head, and in which, when the maintenance section is attached or detached, the carriage moves to a position where the carriage does not face the maintenance section and where the nozzle formed surface faces the support portion.

According to the configuration, when the maintenance section is attached or detached, the carriage moves to a position not facing a maintenance section. In this case, a nozzle formed surface of the liquid ejecting head supporting the carriage is in a state of facing the support portion. That is, the carriage and the liquid ejecting head are not positioned at a position facing the maintenance section. Therefore, it is possible to prevent the maintenance section from contacting a configuration member of the liquid ejecting apparatus such as the liquid ejecting head, the carriage, and the like when a user attaches or detaches the maintenance section on a purpose of replacement and the like. In particular, the nozzle formed surface of the liquid ejecting head faces the support portion, so that it is possible to prevent the nozzle formed surface from contacting the maintenance section.

It is preferable that, when the maintenance section is attached or detached, the carriage of the liquid ejecting apparatus move to a position facing an end portion of a maintenance section side of the support portion in the scanning direction.

According to the configuration, when the maintenance section is attached or detached, the carriage moves to a position facing the end portion of the maintenance section side of the support portion. That is, the carriage is disposed so as to define a support portion side and the maintenance section side. Therefore, when the user attaches or detaches the maintenance section on a purpose of replacement, it is possible to prevent the maintenance section from contacting the support portion defined by the carriage and other configuration members positioned on the support portion side.

It is preferable that the liquid ejecting apparatus further include a case which covers the carriage, the support portion, and the maintenance section from a direction facing the support portion and the maintenance section, and the case has an opening and closing panel which is displaceable between an opening position where the maintenance section is exposed and a closed position where the maintenance section is blocked at a position facing the maintenance section of the case.

According to the configuration, the support portion is covered with a case in a direction facing the support portion. On the other hand, the maintenance section can be covered with a case in a direction facing the maintenance section, and can be exposed by opening operation of the opening and closing panel. In addition, when the maintenance section is attached or detached, the carriage is moved to the end portion of the maintenance section side of the support portion. Therefore, when the maintenance section is attached or detached, the support portion is covered with a case in a direction facing the support portion, and is defined by the carriage from the maintenance section side in the scanning direction. Therefore, when the user attaches or detaches the maintenance section on a purpose of replacement and the like, it is possible to further prevent the maintenance section from contacting the support portion defined by the carriage and other members positioned on the support portion side. In addition, it is also possible to prevent the user's own hand from contacting the support portion and other members positioned on the support portion side.

It is preferable that the liquid ejecting apparatus further include a heating portion, which can heat the target supported by the support portion, between a movement area in which the carriage reciprocates and a case.

According to the configuration, when the maintenance section is attached or detached, the carriage moves to a position facing the end portion of the maintenance section side of the support portion and the heating portion. That is, the carriage is disposed so as to define a side of the support portion and the heating portion and the maintenance section side. Therefore, when the user attaches or detaches the maintenance section on a purpose of the replacement, it is possible to prevent the maintenance section from contacting the support portion and the heating portion defined by the carriage. In addition, it is also possible to prevent the user's own hand from contacting the support portion and the heating portion.

In the liquid ejecting apparatus, it is preferable that when the liquid ejecting head is in a pause state in which the liquid ejecting head does not eject the liquid, at least a portion of the carriage move to a position facing the maintenance section.

According to the configuration, for example, when the liquid ejecting head is in a pause state such as a power off of the apparatus, the user is unlikely to access the maintenance section due to the carriage positioned at a position facing the maintenance section. Therefore, when the liquid ejecting head is in a pause state, by the user's replacement of the maintenance section, it is possible to reduce a risk that the maintenance section according to attachment and detachment is caused to contact the internal structure of the liquid ejecting apparatus such as the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which a liquid ejecting apparatus is embodied in an ink jet printer (hereinafter, simply referred to as "printer") will be described referring to drawings.

Figure 1:
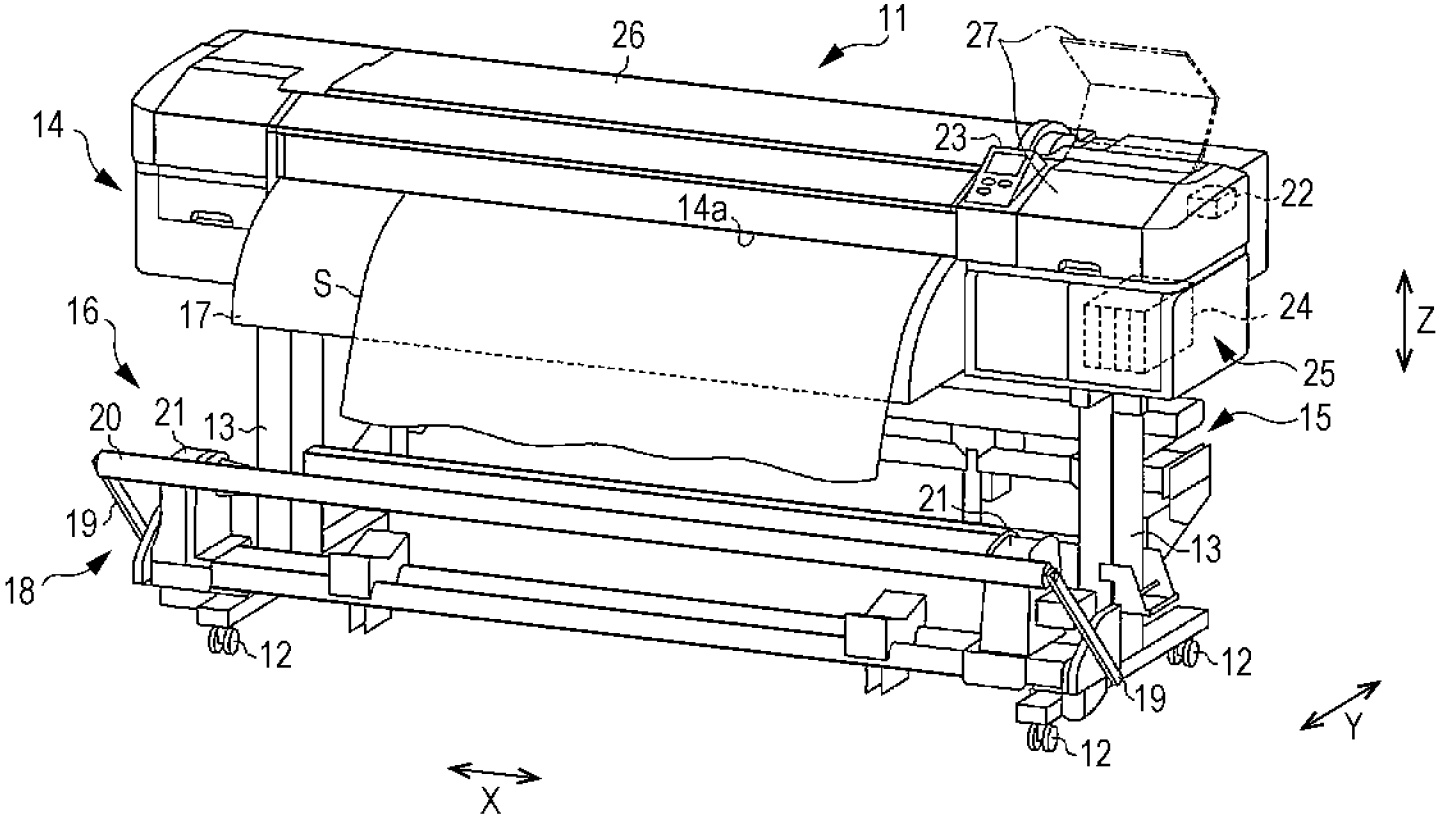
FIG. 1 is a perspective view showing a printer.

As shown in FIG. 1, a printer 11 is a large format printer (LFP) which handles a long sheet S which is an example of a target. Then, the printer 11 includes a pair of leg portions 13 where wheels 12 are attached to the lower end, and a housing 14 assembled onto the leg portions 13. In the embodiment, a direction along the direction of gravity is set as a vertical direction Z, and a longitudinal direction of the housing 14 intersecting (orthogonal in the embodiment) the vertical direction is set as a scanning direction X. In addition, a direction intersecting (orthogonal in the embodiment) both the vertical direction Z and the scanning direction X is set as front and rear directions of Y.

At a lower and rear side of the housing 14, a feeding unit 15 is disposed which feeds the sheet S towards the housing 14 side. At a lower and front side of the housing 14, a winding unit 16 is disposed which winds the sheet S discharged from the housing 14. Between the feeding unit 15 and the winding unit 16, a guide unit 17 is disposed along a transportation path of the sheet S. The rear end of the guide unit 17 is accommodated in the housing 14, and the front end of the guide unit 17 protrudes towards the front of the housing 14. In addition, on the front surface side of the housing 14, a discharge port 14*a* for discharging the sheet S from the inside of the housing 14 is formed at a position which is an upper side of the guide unit 17.

At a position in the vicinity of the winding unit 16, a tension applying mechanism 18 is provided which applies tension to a sheet S positioned between the guide unit 17 and the winding unit 16. The tension applying mechanism 18 includes a pair of arm members 19 which are rotatably supported at the bottom of the leg portions 13, and a tension roller 20 which is rotatably supported at the tip of the pair of arm members 19. In addition, the winding unit 16 includes a pair of holders 21 interposing a core (for example, sheet tube), which winds the sheet S after printing in a cylindrical shape and is not illustrated, between both sides in the axial direction.

In addition, the housing 14 includes a control unit 22 which controls an operation of the printer 11, an operation panel 23 for performing a setting operation and an input operation on the printer 11, and a cartridge holder 25 detachably mounting an ink cartridge 24 which can accommodate an ink. The control unit 22 is provided inside the housing 14 of the printer 11, and on the other hand, the operation panel 23 is provided at the upper portion of the housing 14. Then, the control unit 22 and the operation panel 23 are electrically connected to each other in the housing 14. In addition, the cartridge holder 25 is provided on a first end side (right end side in FIG. 1) which is an outer side of the transportation path of the sheet S in the scanning direction X of the bottom of the housing 14.

In addition, the housing 14 includes the case 26 covering entirely over the upper portion of the housing 14, and the opening and closing panel 27 formed in the case 26. The opening and closing panel 27 is provided at the first end side of the upper portion of the housing 14, and is rotatably provided with respect to the case 26 as shown by a two-dot dashed line in FIG. 1.

Next, an internal structure of the housing 14 will be described.

Figure 2:
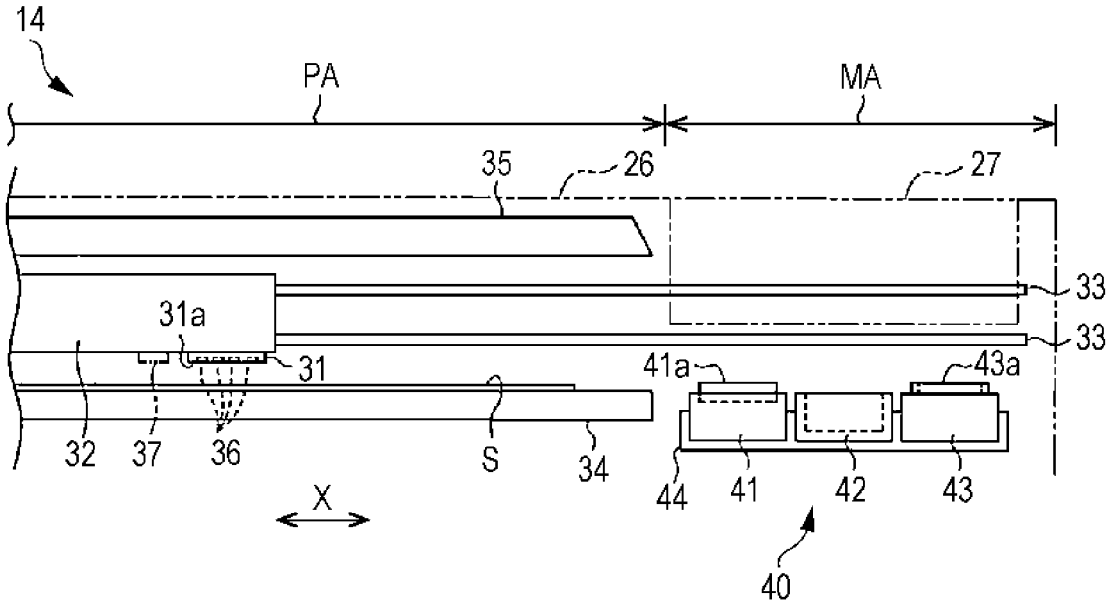
FIG. 2 is a view showing a schematic configuration inside a housing of the printer.

As shown in FIG. 2, in the housing 14, a print area PA in which a configuration related to the printing of the printer 11 is provided and a maintenance area MA in which a configuration related to the maintenance of the printer 11 is provided are arranged in the scanning direction X. In addition, in the embodiment, the print area PA and the maintenance area MA are equivalent to a movement area in which a carriage 32 reciprocates in the scanning direction X.

A liquid ejecting head 31 which is capable of ejecting an ink towards the sheet S, the carriage 32 which can reciprocate in the scanning direction X (scanning direction) with the liquid ejecting head 31 held, and a guide rail 33 which guides the reciprocating movement of the carriage 32 are provided in the housing 14. In addition, a support portion 34 which can support the sheet S, and a heating portion 35 which can heat the sheet S supported by the support portion 34 are provided in the printing area PA in the housing 14.

The liquid ejecting head 31 is held at the bottom of the carriage 32 so that a nozzle formed surface 31*a* where nozzles 36 ejecting an ink are formed faces the sheet S. In addition, the liquid ejecting head 31 is provided at a first end side (a right side in FIG. 2) of the carriage 32 in the scanning direction X. The carriage 32 is slidable with two guide rails 33 extending in the scanning direction X, and is guided to the guide rails 33, thereby reciprocating in the scanning direction X. In addition, the support portion 34 can support the sheet S fed into the housing 14 over the scanning direction X. The heating portion 35 has the length corresponding to the support portion 34 in the scanning direction X and is disposed between the movement area of the carriage 32 and the case 26. In addition, the heating portion 35 heats an ink ejected onto the sheet S which is supported on the support portion 34, thereby fixing the ink. That is, a side of the heating portion 35 facing the sheet S is hot.

In the maintenance area MA of the housing 14, in order to maintain good ink ejection characteristics of the liquid ejecting head 31, a maintenance section 40 which can perform the maintenance of the liquid ejecting head 31 is provided. The maintenance section 40 has a wiper unit 41, a flushing box 42, and a cap unit 43 from the support portion 34 side to the first end side (from a left side to a right side in FIG. 2). In addition, in the maintenance section 40, a mount portion 44 which causes the wiper unit 41, the flushing box 42, and the cap unit 43 to be detachably mounted thereon is provided. In the embodiment, the wiper unit 41, the flushing box 42, and the cap unit 43 are examples of the maintenance section which can perform the maintenance of the liquid ejecting head 31.

The wiper unit 41 includes a wiping member 41*a* in a long shape, which absorbs and removes an ink, and the wiping member 41*a* is insertably held in the wiper unit 41. Then, the wiper unit 41 wipes an ink using a wiping member 41*a* which has not absorbed an ink by repeating a step of wiping an ink adhered to the nozzle formed surface 31*a* using the wiping member 41*a* and a step of inserting the wiping member 41*a*. That is, the wiper unit 41, when an ink adheres to the nozzle formed surface 31*a* of the liquid ejecting head 31, performs "wiping" to wipe the ink. In addition, the wiper unit 41 is replaced, as an example, when there are a lot of portions of the wiping member 41*a* which has absorbed an ink.

The flushing box 42 can accommodate an ink ejected towards the flushing box 42 and store the ink. That is, the flushing box 42 accommodates and stores an ink ejected at the time of "flushing" that the liquid ejecting head 31 ejects an ink regardless of printing. The flushing is performed so as to prevent an ink from being thickened and the like in the liquid ejecting head 31. The flushing may eject an ink only from a nozzle 36 through which an ink has not been ejected for a while, and may also eject an ink from whole nozzles 36. In addition, the flushing box 42 is replaced, for example, when an amount of stored ink is large.

The cap unit 43 includes a cap 43*a* which can be brought into contact with the nozzle formed surface 31*a* of the liquid ejecting head 31, and a suction unit (not shown) which can suck the cap 43*a* brought into contact with the nozzle formed surface 31*a*. Then, the cap unit 43 performs "cleaning" to cause a thickened ink to be discharged from the nozzles 36 in the liquid ejecting head 31 by absorbing the inside of the cap 43*a* brought into contact with the nozzle formed surface 31*a*. In addition, as an example, the cap unit 43 is replaced when the cap 43*a* is deformed to cause a failure of being brought into contact with the nozzle formed surface 31*a*.

In addition, at a position facing the maintenance section 40, the opening and closing panel 27 described above, is displaceable between an open position to expose the maintenance section 40 and a closed position to block the maintenance section 40. Therefore, a detachable replacement of the wiper unit 41, the flushing box 42, and the cap unit 43 is performed when the opening and closing panel 27 is positioned at the open position.

Next, an operation of the printer 11 will be described.

As shown in FIG. 2, when printing is performed on the sheet S, the carriage 32 reciprocates the print area PA in the scanning direction X, and at the same time an ink is ejected towards the sheet S from the liquid ejecting head 31 held at the carriage 32.

Then, during printing, when the carriage 32 reciprocates a plurality of times, the carriage 32 is moved so that the liquid ejecting head 31 faces the flushing box 42 to perform the flushing. In addition, when an ink is not continuously ejected from the liquid ejecting head 31 over a long period of time, the carriage 32 is moved so that the liquid ejecting head 31 faces the cap unit 43 to perform the cleaning. In addition, when an ink adheres to the nozzle formed surface 31*a* of the liquid ejecting head 31 after performing the cleaning, the carriage 32 is moved so that the liquid ejecting head 31 faces the wiper unit 41 to perform the wiping.

Figure 3:
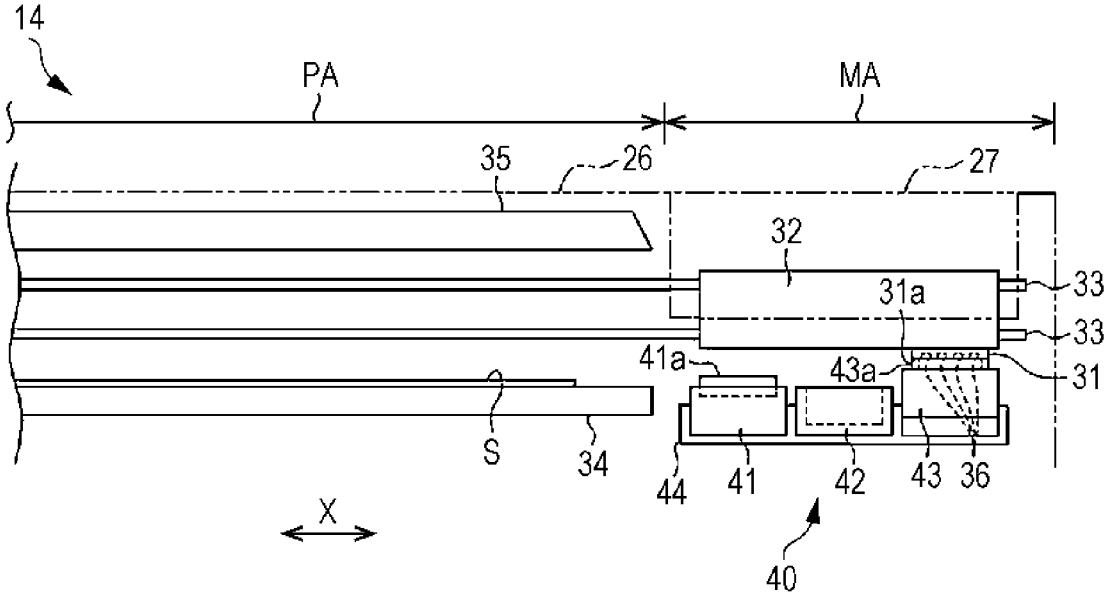
FIG. 3 is a schematic view of the inside of the housing which shows a disposition of a carriage in a pause state.

As shown in FIG. 3, when the liquid ejecting head 31 is in a pause state of not ejecting an ink such as when printing is not performed even at the time of power-off of the printer 11 or at the time of power-on of the printer 11, the carriage 32 is moved so that the liquid ejecting head 31 faces the cap unit 43 (maintenance section 40). Then, for the purpose of preventing the ink from being dried in the liquid ejecting head 31 such as the nozzles 36, the cap 43*a* is brought into contact with the nozzle formed surface 31*a* of the liquid ejecting head 31. In this case, if pause time is short, the cap 43*a* may not be brought into contact with the nozzle formed surface 31*a* of the liquid ejecting head 31.

In this way, the carriage 32 covers the maintenance section 40 over the scanning direction X even when opening the opening and closing panel 27 is in a pause state. Accordingly, a user of the printer 11 hardly touches the maintenance section 40, and a replacement of the maintenance section 40 is prevented in a pause state.

Next, an operation related to the replacement of the maintenance section 40 in the printer 11 will be described.

When the maintenance section 40 is continuously used and the time for replacing the maintenance section comes as described above, the printer 11 notifies and urges a user to replace the maintenance section 40. Then, the user issues a command of replacing the maintenance section 40 to the printer 11 through the operation panel 23 of the printer 11 when performing the replacement of the maintenance section 40.

Figure 4A:
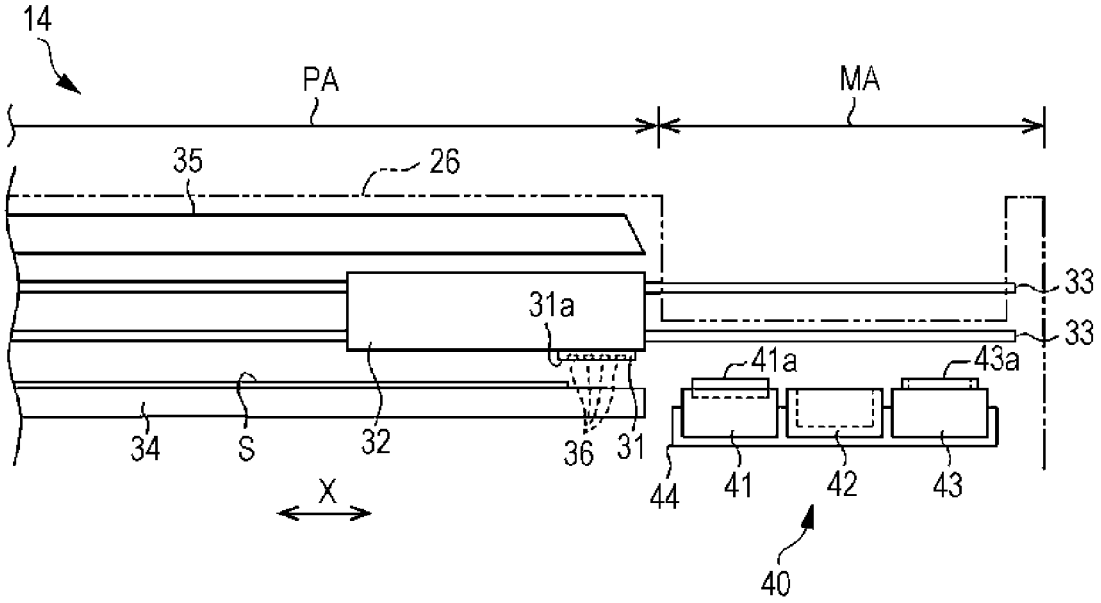
FIGS. 4A and 4B are schematic views describing an operation according to a replacement of a maintenance section.
Figure 4B:
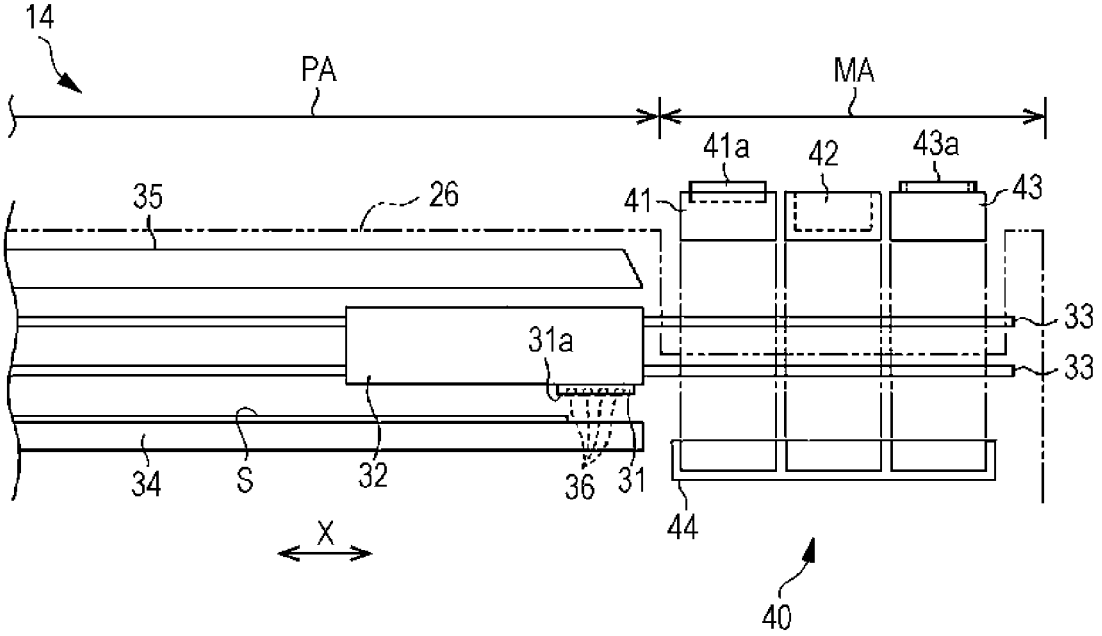

As shown in FIG. 4A, when replacing the maintenance section 40, the carriage 32 is moved to a position facing an end portion of the maintenance section 40 side of the support portion 34 in the scanning direction X. This position is a position where the carriage 32 does not face the maintenance section 40, and where the nozzle formed surface 31*a* faces the support portion 34. Then, the user opens the opening and closing panel 27, and thus, the maintenance area MA is exposed outside the housing 14. In FIGS. 4A and 4B, to keep the description brief, the opening and closing panel 27 in an open state is not described.

As shown in FIG. 4B, the maintenance section 40 (the wiper unit 41, the flushing box 42, and the cap unit 43) is removed by the user. At this time, the carriage 32 is positioned on the maintenance area MA side of the print area PA, and thereby the carriage 32 defines the print area PA and the maintenance area MA. Therefore, when removing the maintenance section 40, the maintenance section 40 is prevented from touching each configuration member in the housing 14 such as the liquid ejecting head 31, the support portion 34, the heating portion 35, and the like. In the same manner, when removing the maintenance section 40, a user's hand is prevented from touching each configuration member in the housing 14 such as the liquid ejecting head 31, the support portion 34, the heating portion 35, and the like.

Then, after taking off a used maintenance section 40 from an opening of the case 26 formed by the opening and closing panel 27 positioned at the open position, a replacement maintenance section 40 (the wiper unit 41, the flushing box 42, and the cap unit 43) is mounted on the mount portion 44. Even at the time of the mount, in the same manner as the time of taking off, it is possible that the maintenance section 40 is unlikely to contact each configuration member in the housing 14 according to the mount by the carriage 32 positioned so as to define the print area PA and the maintenance area MA.

Then, when a detachable replacement of the maintenance section 40 is completed and the detachable replacement requires time, according to the time, maintenance such as flushing or cleaning may be performed. For example, when time required for the detachable replacement is shorter than predetermined time (for example, 10 minutes), flushing may be performed, and when the time is longer than the predetermined time, cleaning may be performed. The wiper unit 41, the flushing box 42, and the cap unit 43 do not need to be entirely replaced at the same time as described above.

According to the embodiment, it is possible to obtain an effect shown below.

(1) When the maintenance section 40 is attached or detached, the carriage 32 is moved to a position away from the maintenance area MA where the maintenance section 40 is mounted. In addition, in this case, the nozzle formed surface 31*a* of the liquid ejecting head 31 held by the carriage 32 faces the support portion 34. Therefore, when a user attaches or detaches the maintenance section 40 (the wiper unit 41, the flushing box 42, and the cap unit 43), it is possible to prevent the maintenance section 40 from contacting configuration members of the printer 11 such as the liquid ejecting head 31, the carriage 32, and the like. In particular, the nozzle formed surface 31*a* of the liquid ejecting head 31 faces the support portion 34, so that it is possible to prevent the nozzle formed surface 31*a* from contacting the maintenance section 40. Therefore, the configuration members of the printer 11 contact the maintenance section 40 according to the replacement, and thereby it is possible to reduce a risk to make a normal operation impossible.

(2) When the maintenance section 40 is attached or detached, the carriage 32 is moved to a position facing the end portion of the maintenance section 40 side of the support portion 34. That is, the carriage 32 is disposed so as to define the support portion 34 (the print area PA) side and the maintenance section 40 (the maintenance area MA) side. Therefore, when the user attaches or detaches the maintenance section 40, it is possible to prevent the maintenance section 40 from contacting the support portion 34 and other configuration members positioned at the support portion 34 side.

(3) When the maintenance section 40 is attached or detached, the support portion 34 is covered by the case 26 from a side (upper side) facing the support portion 34, and defined by the carriage 32 from the maintenance section 40 side (the first end side) in the scanning direction X. Therefore, when the user attaches or detaches the maintenance section 40, it is possible to further prevent the maintenance section 40 from contacting the support portion 34 defined by the carriage 32 and other members positioned at the support portion 34 side. In addition, even when not attaching or detaching the maintenance section 40, it is possible to prevent the user's own hand from contacting the support portion 34 and other members positioned at the support portion 34 side.

(4) The carriage 32 is disposed so as to define not only the support portion 34 but also the print area PA side including the heating portion 35 and the maintenance area MA side. Therefore, when the user attaches or detaches the maintenance section 40, it is possible to prevent the maintenance section 40 from contacting the support portion 34 and the heating portion 35 defined by the carriage 32. In addition, even when not attaching or detaching the maintenance section 40, it is possible to prevent the user's own hand from contacting not only the support portion 34 but also the heating portion 35. In particular, it is possible to prevent the user's own hand from contacting a surface of the side of the support portion 34 supporting the sheet S and a surface of the side of the heating portion 35 facing the sheet S.

(5) When the liquid ejecting head 31 is in a pause state such as the time of power-off of the printer 11, the user is unlikely to access the maintenance section 40 by the carriage 32 positioned at a position facing the maintenance section 40. Therefore, when the liquid ejecting head 31 is in a pause state, it is possible to reduce a risk of causing the maintenance section 40 to contact the liquid ejecting head 31 and the like by user's replacing the maintenance section 40.

(6) In the scanning direction X, the length of the carriage 32 is configured to have a length covering the maintenance section 40, so that it is possible for the carriage 32 to cover the maintenance section 40 over the scanning direction X in a stop state. Therefore, it is possible to make it difficult for the user to attach or detach the maintenance section 40 in a stop state, and it is possible to reduce a risk that the maintenance section 40 contacts the internal structure of the printer 11 such as the liquid ejecting head 31 in the stop state.

The embodiment may be changed as follows.

As shown by two-dot dashed line in FIG. 2, various types of sensors 37 may be provided on a surface facing the support portion 34 of the carriage 32. As an example of the sensors 37, there is a temperature sensor measuring the temperature of the nozzle formed surface 31*a* or a sheet-end sensor detecting the sheet end in the scanning direction X. In addition, when an ink ejected using not only the sensor 37 but also the liquid ejecting head 31 is a UV curing ink, a UV irradiation unit irradiating UV may be provided. Then, when the maintenance section 40 is attached or detached, these sensors 37 and the irradiation unit may move the carriage 32 to a position facing the support portion 34. Accordingly, it is possible to prevent the sensors 37 and the irradiation unit from contacting the maintenance section 40 according to attachment or detachment.

In the embodiment, an attachment and detachment direction (upward) of the maintenance section 40 intersects (orthogonal) with a scanning area of the carriage 32, but the attachment and detachment direction may not surely intersect with the scanning area. For example, the attachment and detachment direction of the maintenance section 40 may also be set as a direction following the front and rear direction Y. Even in this case, according to a method of mounting the maintenance section 40, there is a risk that the maintenance section 40 is lifted upward to contact a configuration member in the housing 14 such as a liquid ejecting head 31. Therefore, it is possible to obtain the same effect as in the embodiment by causing the carriage 32 to be positioned at the maintenance area MA side of the support portion 34.

The wiper unit 41, the flushing box 42, and the cap unit 43 may not be collectively provided at the first end side (a right side in FIG. 2) of the printer 11. For example, the flushing box 42 may be also provided at a second end side (a left side in FIG. 2) which is an opposite side to the first end side of the support portion 34. In this case, when attaching or detaching the flushing box 42 of the second end side, it is preferable that the carriage 32 moves to a position facing an end portion of the second end side of the support portion 34.

The carriage 32 may move to any position facing the support portion 34 at the time of attaching or detaching the maintenance section 40. Even in this case, it is possible to at least prevent the nozzle formed surface 31*a* of the liquid ejecting head 31 from contacting the maintenance section 40 according to attachment or detachment.

When the maintenance section 40 is attached or detached, a position facing the end portion of the maintenance section 40 side of the support portion 34, where the carriage 32 is positioned, as shown in FIGS. 4A and 4B, does not require an accuracy on a match between an end surface of a first end side (a right side in FIGS. 4A and 4B) of the carriage 32 and an end surface of a first end side of the support portion 34. For example, in a range that the liquid ejecting head 31 faces the support portion 34, the carriage 32 may move in the scanning direction X from a position facing the support portion 34 shown in FIGS. 4A and 4B to be positioned.

As shown in FIG. 3, the liquid ejecting head 31 is in a pause state, and even though the whole portion of the carriage 32 does not face the maintenance section 40, a portion of the carriage 32 may face the maintenance section 40.

In the scanning direction X, the length of the carriage 32 may be shorter or longer than the length of the maintenance section 40.

In the maintenance area MA, the wiper unit 41, the flushing box 42, and the cap unit 43 may be arranged in a different order.

Among the wiper unit 41, the flushing box 42, and the cap unit 43, any one or two may be omitted.

The heating portion 35 may be omitted.

In the embodiment, the liquid ejecting apparatus may be a liquid ejecting apparatus which ejects or discharges a liquid other than an ink. The state of the liquid which is a small amount of droplet discharged from the liquid ejecting apparatus includes those leaving a trail in a granular shape, a teardrop shape, or a filament shape. In addition, the liquid herein may be a material which can be ejected from the liquid ejecting apparatus. For example, the substance may be in a state of a liquid phase and includes a fluid-like material such as a liquid having a high or low viscosity, sol, gel water, other inorganic solvents, organic solvents, solutions, liquid resins, liquid metals (metal melt). In addition, a state of the substance is not only liquid but also those including particles of functional material made of a solid matter such as pigment and metal particles dissolved, dispersed, or mixed in a solvent. A typical example of the liquid includes the ink described in the embodiment and a liquid crystal. Here, the ink includes various types of liquid composition such as a general water-based ink, an oil-based ink, a gel ink, a hot melt ink, and the like. For example, a specific example of the liquid ejecting apparatus is a liquid ejecting apparatus which ejects a liquid including a dispersed or dissolved material such as an electrode material or a coloring material used in manufacturing a liquid crystal display, an electroluminescence (EL) display, a surface emitting display, and a color filter. Moreover, the liquid ejecting apparatus may be a liquid ejecting apparatus which ejects a living organic material used in manufacturing a biochip, a liquid ejecting apparatus which ejects a liquid as a sample used as a precision pipette, a printing device, a micro-dispenser, and the like. Furthermore, the liquid ejecting apparatus may be a liquid ejecting apparatus which ejects a lubricant oil to a precision machine such as a clock, a camera, and the like using a pin point, and a liquid ejecting apparatus which ejects a transparent resin liquid such as a UV-curing resin and the like onto a substrate so as to form a minute hemispherical lens (optical lens) used in an optical communication element. In addition, the liquid ejecting apparatus may be a liquid ejecting apparatus which ejects an etchant such as acid or alkali so as to etch the substrate and the like.

The entire disclosure of Japanese Patent Application No. 2013-041592, filed Mar. 4, 2013 is expressly incorporated by reference herein.

What is claimed is:

1. A liquid ejecting apparatus comprising:

a liquid ejecting head having a nozzle formed surface on which a nozzle which is capable of ejecting a liquid towards a target is formed;

a support portion which can support the target to which the liquid is ejected;

a carriage which can reciprocate in a scanning direction and which can hold the liquid ejecting head;

a maintenance section which is detachably mounted on a maintenance area outside the support portion in the scanning direction to perform maintenance on the liquid ejecting head, the maintenance section including a plurality of maintenance units;

a case which covers the carriage, the support portion, and the maintenance section in a direction facing the support portion and the maintenance section;

a controller configured to position the carriage at a position where the nozzle formed surface faces the support portion when the maintenance section is detached from the maintenance area, wherein the position is next to a boundary between a print area and the maintenance section; and wherein the case includes an opening and closing panel which is displaceable between an opening position where the maintenance section is exposed and a closed position where the maintenance section is blocked at a position facing the maintenance section of the cased.

2. The liquid ejecting apparatus according to claim 1, wherein the carriage and the support portion remain covered by the case when the panel is in the opening position and the maintenance section is exposed so that the carriage prevents the maintenance section from contacting the support portion and other configuration members positioned in the print area during detachment and attachment of the maintenance section.

3. The liquid ejecting apparatus according to claim 1, further comprising a heating portion which can heat the target supported by the support portion between a movement area in which the carriage reciprocates and the case.

4. The liquid ejecting apparatus according to claim 1, wherein, when the liquid ejecting head is in a pause state in which the liquid ejecting head does not eject the liquid, at least a portion of the carriage moves to a position facing the maintenance section.

5. The liquid ejecting apparatus of claim 1, wherein the plurality of maintenance units include a wiper unit that wipes liquid adhered to the nozzle formed surface, a flushing part that accommodates liquid ejected from the liquid ejecting head, and a cap unit that comes into contact with the nozzle formed surface.

6. The liquid ejecting apparatus of claim 1, wherein the entire maintenance section is configured to be replaced.

7. The liquid ejecting apparatus according to claim 1, wherein the maintenance section is configured to be detached from the maintenance area in an upward direction that is transverse to both a movement direction of the carriage and to a front to rear direction of the liquid ejecting apparatus.

8. A liquid ejecting apparatus comprising:

a liquid ejecting head having a nozzle formed surface on which a plurality of nozzles capable of ejecting a liquid towards a target are formed;

a support portion supporting the target to which the liquid is ejected;

a carriage reciprocating in a scanning direction and which holds the liquid ejecting head;

a maintenance section that is detachably mounted on a maintenance area outside the support portion in the scanning direction to perform maintenance on the liquid ejecting head, the maintenance section including a plurality of maintenance units; and a controller configured to position the carriage at a position where the nozzle formed surface faces the support portion when the maintenance section is entirely attached or detached to the maintenance area, wherein the position is next to a boundary between a print area and the maintenance section;

wherein the plurality of nozzles form a plurality of nozzle groups in the scanning direction, wherein the plurality of maintenance units include a wiper unit that can wipe liquid adhered to the nozzle formed surface including the plurality of nozzle groups, a flushing part that can accommodate liquid ejected from the plurality of nozzle groups, and a cap unit that can come in contact with the nozzle formed surface including the plurality of nozzle groups.

9. The liquid ejecting apparatus according to claim 8, wherein, when the maintenance section is attached to the maintenance area or detached, the carriage moves to a position facing an end portion of a maintenance section side of the support portion in the scanning direction so as to define the maintenance area and an area that the support portion is located.

10. The liquid ejecting apparatus according to claim 9, further comprising:

a case covering the carriage, the support portion, and the maintenance section in a direction facing the support portion and the maintenance section, wherein the case has an opening and closing panel which is displaceable between an opening position where the maintenance section is exposed and a closed position where the maintenance section is blocked at a position facing the maintenance section of the case.

11. The liquid ejecting apparatus according to claim 8, further comprising:

a heating portion heating the target supported by the support portion.

12. The liquid ejecting apparatus according to claim 8, wherein, when the liquid ejecting head is in a pause state in which the liquid ejecting head does not eject the liquid, at least a portion of the carriage moves to a position facing the maintenance section.

13. A liquid ejecting apparatus comprising:

a liquid ejecting head having a nozzle formed surface on which a nozzle which is capable of ejecting a liquid towards a target is formed;

a support portion supporting the target to which the liquid is ejected;

a carriage reciprocating in a scanning direction and which holds the liquid ejecting head;

a maintenance section that is detachably mounted on a maintenance area outside the support portion in the scanning direction to perform maintenance on the liquid ejecting head, the maintenance section including a wiper unit that can wipe liquid adhered to the nozzle formed surface and a flushing part that can accommodate liquid ejected from the liquid ejecting head, the wiper unit and the flushing part being arranged along an arrangement direction along the scanning direction; and a controller configured to position the carriage at a position where the nozzle formed surface faces the support portion when the maintenance section is attached or detached to the maintenance area, wherein the position is next to a boundary between a print area and the maintenance section;

wherein the maintenance section is attached or detached along an attachment and detachment direction intersecting the arrangement direction.

14. The liquid ejecting apparatus according to claim 13, wherein the maintenance section includes a cap unit that can come into contact with the nozzle formed surface, and wherein the wiper unit, the flushing part and the cap unit are attached or detached along the attachment and detachment direction.

15. The liquid ejecting apparatus according to claim 13, wherein the attachment and detachment direction is a direction along the nozzle formed surface.

16. The liquid ejecting apparatus according to claim 13, wherein the maintenance section is configured to be entirely attached or detached.

17. The liquid ejecting apparatus according to claim 13, wherein the maintenance section is replaceable as a whole and wherein each maintenance unit is individually replaceable.

18. The liquid ejecting apparatus according to claim 13, further comprising:

a case covering the carriage, the support portion, and the maintenance section in a direction facing the support portion and the maintenance section, wherein the case has an opening and closing panel which is displaceable between an opening position where the maintenance section is exposed and a closed position where the maintenance section is blocked at a position facing the maintenance section of the case.

19. The liquid ejecting apparatus according to claim 13, further comprising:

a heating portion heating the target supported by the support portion.

* * * * *